US009964088B2

(12) United States Patent
Zhang

(10) Patent No.: US 9,964,088 B2
(45) Date of Patent: May 8, 2018

(54) MULTI-HOLE FUEL INJECTOR WITH SEQUENTIAL FUEL INJECTION

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 16 days.

(21) Appl. No.: 14/997,756

(22) Filed: Jan. 18, 2016

(65) Prior Publication Data

US 2017/0204826 A1 Jul. 20, 2017

(51) Int. Cl.

| | |
|---|---|
| ***F02M 61/18*** | (2006.01) |
| ***F02D 41/38*** | (2006.01) |
| ***F02M 61/10*** | (2006.01) |
| ***F02M 61/06*** | (2006.01) |

(52) U.S. Cl.

CPC ..... *F02M 61/1813* (2013.01); *F02D 41/38* (2013.01); *F02M 61/06* (2013.01); *F02M 61/10* (2013.01); *F02M 61/1873* (2013.01); *F02D 2041/389* (2013.01); *F02D 2200/021* (2013.01); *F02D 2200/101* (2013.01)

(58) Field of Classification Search

CPC .... F02M 61/1813; F02M 61/10; F02D 41/38; F02D 2041/389; F02D 2041/38

See application file for complete search history.

(56) References Cited

U.S. PATENT DOCUMENTS

| | | | | |
|---|---|---|---|---|
| 3,892,362 | A * | 7/1975 | Gayfer | F02M 51/04 239/533.9 |
| 4,685,432 | A * | 8/1987 | Saito | F02B 23/0624 123/263 |
| 5,588,412 | A * | 12/1996 | Nozaki | F02M 61/182 123/446 |
| 7,198,024 | B2 * | 4/2007 | Coleman | F02B 1/12 123/305 |
| 7,444,980 | B2 * | 11/2008 | Cavanagh | F02M 61/182 123/299 |
| 7,770,556 | B2 | 8/2010 | Kihara et al. | |
| 2003/0201344 | A1 * | 10/2003 | Wark | F02M 47/00 239/533.8 |
| 2013/0181068 | A1 * | 7/2013 | Dantes | F02M 61/1813 239/557 |

FOREIGN PATENT DOCUMENTS

WO 2004053326 A1 6/2004

* cited by examiner

*Primary Examiner* — Joseph Dallo
*Assistant Examiner* — Kurt Liethen
(74) *Attorney, Agent, or Firm* — Julia Voutyras; McCoy Russell LLP

(57) ABSTRACT

Methods and systems are provided for direct fuel injection. In one example, a fuel injector system includes an injector needle with an injector pin with a curved fuel channel around the outer circumference of the injector pin, fluidically connected along the length of the curved fuel channel with a fuel reservoir inside the injector pin. An actuator coupled to the injector needle may sequentially move and position the injector needle to establish fluidic connection between the curved fuel channel and with one or more nozzle holes of the fuel injector at each position, discharging fuel from only those nozzle holes, thereby minimizing fuel spray interaction.

20 Claims, 8 Drawing Sheets

MULTI-HOLE FUEL INJECTOR WITH SEQUENTIAL FUEL INJECTION

FIELD

The present description relates generally to methods and systems for controlling direct fuel injection in an internal combustion engine of a vehicle.

BACKGROUND/SUMMARY

Internal combustion engines may utilize direct fuel injection, wherein a precisely controlled amount of fuel is injected under high pressure into each engine cylinder, thereby increasing fuel efficiency and power output of the engine. In traditional direct fuel injectors, the injector nozzle hole configuration and geometry can regulate combustion characteristics and affect vehicle emissions. The fuel is typically injected from a sac at the tip of the fuel injector needle into the engine cylinder through a plurality of holes, configured in various forms to increase atomization and improve air-fuel mixing.

One example approach for improving air-fuel mixing with a direct injector is shown by WO 2004053326. Therein, a fuel injector nozzle comprises a plurality of nozzle holes and a freely moving ball located inside a swirl fuel passage in the fuel nozzle. The swirl generated by an injector needle, which swirls the free-moving ball to block holes in the fuel injector nozzle, controls fuel injection through the holes of the fuel injector nozzle.

However, the inventors herein have recognized some issues with the above approach. For example, the position of the free moving ball in the swirl fuel passage may not be precisely controlled to close or open specific nozzle holes, resulting in a randomized pattern of fuel spray through the nozzle holes that may result in fuel spray interaction. In addition, the random positioning of the free moving ball to block fuel spray through the nozzle holes may result in use of some nozzle holes more than other nozzle holes, which may result in longer fuel penetration and degraded emissions.

In one example, the issues described above may be addressed by a fuel injector system including an injector body with a plurality of nozzle holes and an injector needle coupled to an injector pin. The injector pin includes a curved fuel channel in fluidic communication with a fuel reservoir inside the injector pin. The injector needle and pin are housed inside the injector body, and the curved fuel channel is configured to be in fluidic communication with the plurality of nozzle holes when the injector needle is actuated.

As one example, an actuator coupled to the needle may be activated to push the needle downward, thus moving the pin down through a plurality of positions. At each position, one or more specific fuel injector nozzle holes are fluidically coupled to the fuel reservoir via the curved fuel channel, while all other nozzle holes are blocked. In this way, as the pin is moved downward, each set of nozzle holes injects fuel. The nozzle holes and curvature of the fuel channel may be arranged such that adjacent nozzle holes do not simultaneously inject fuel, thus avoiding interaction between the fuel spray from adjacent nozzle holes. In doing so, the number of nozzle holes may be increased and spray atomization may be enhanced while reducing spray penetration length, thus promoting fuel mixing and increasing combustion efficiency.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
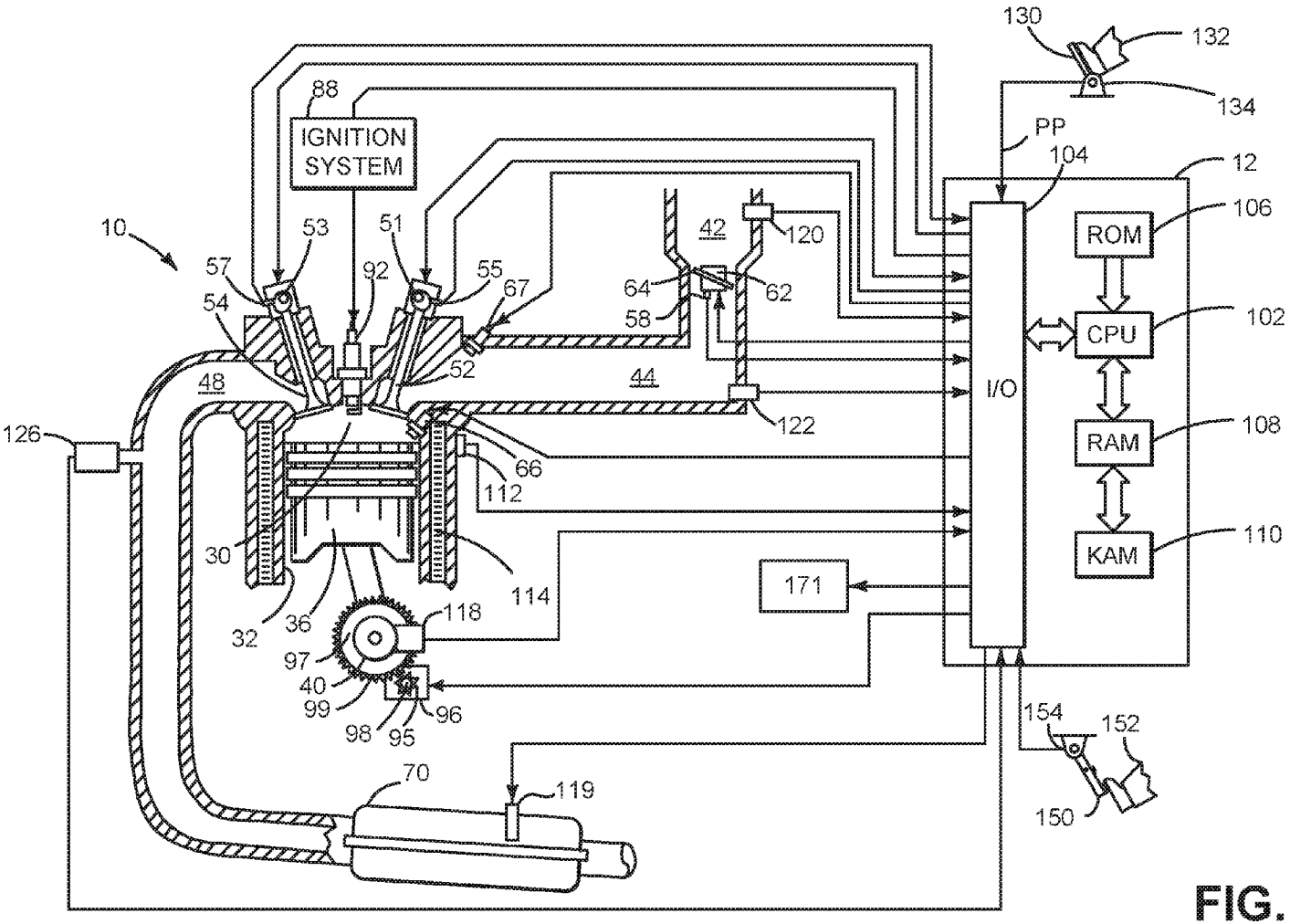
FIG. 1 shows a schematic depiction of an internal combustion engine.
Figure 2:
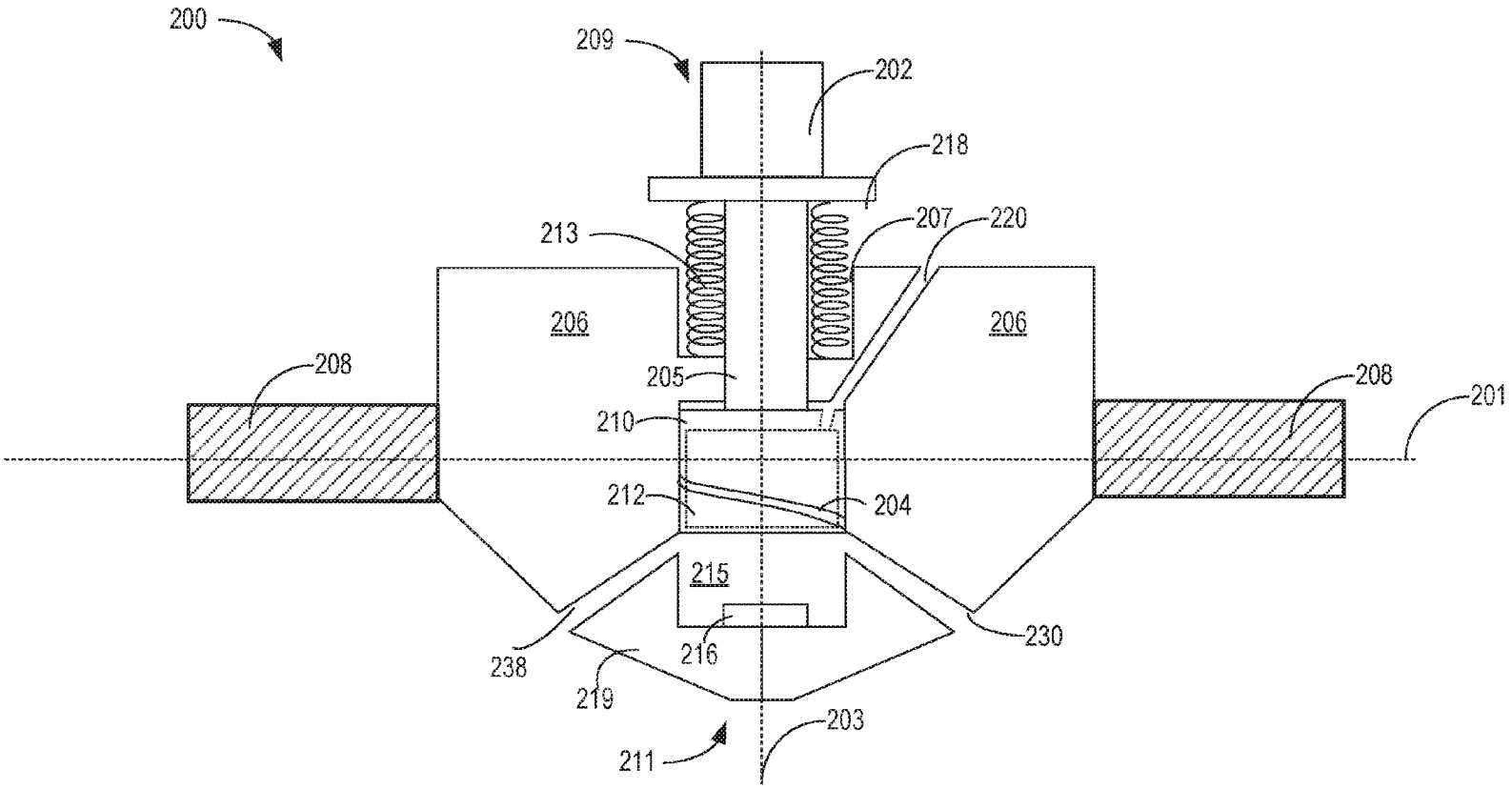
FIG. 2 shows an example of a direct fuel injector assembly used in the engine of FIG. 1 in a deactivated position.
Figure 3:
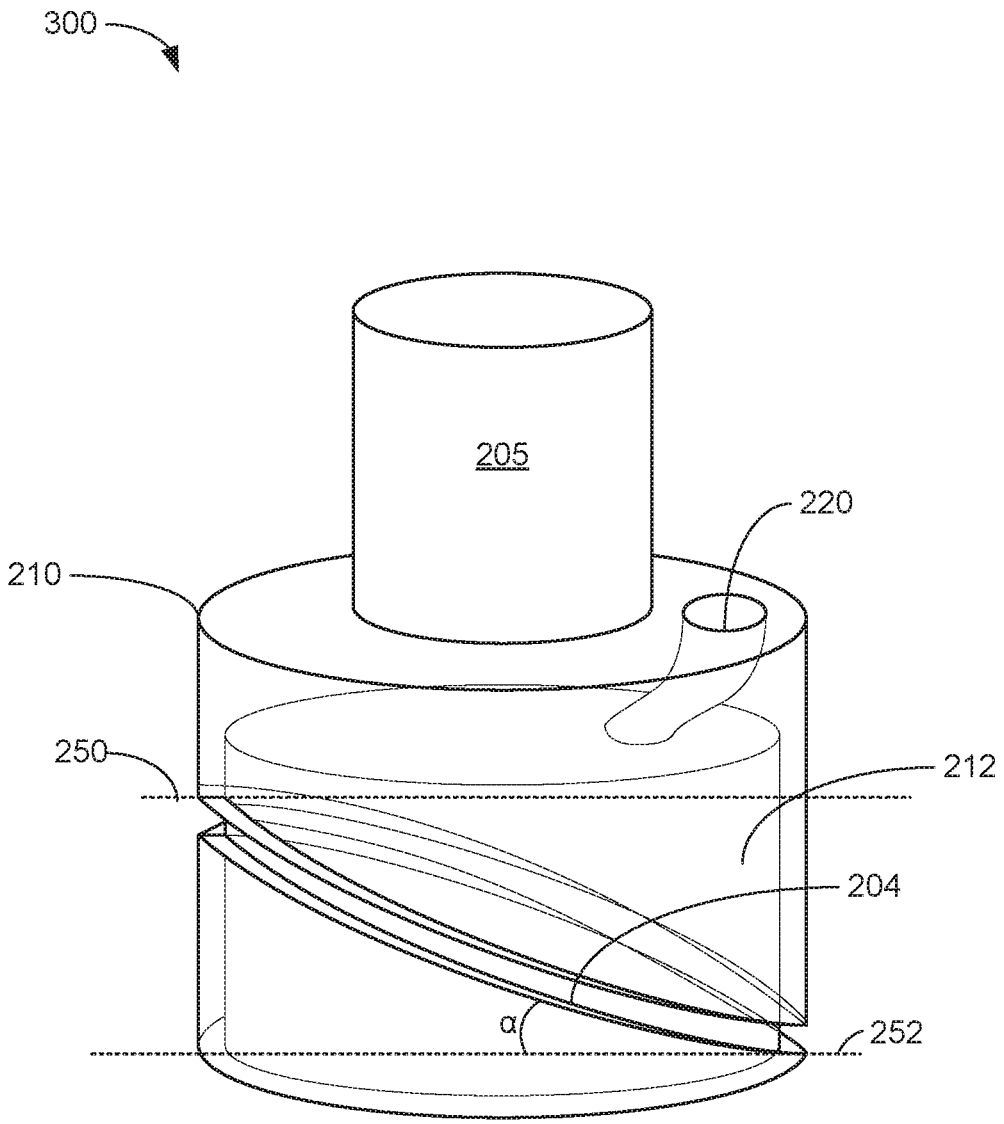
FIG. 3 illustrates an injector needle with an injector pin having a curved fuel channel around an outer circumference of the injector needle pin.
Figure 4:
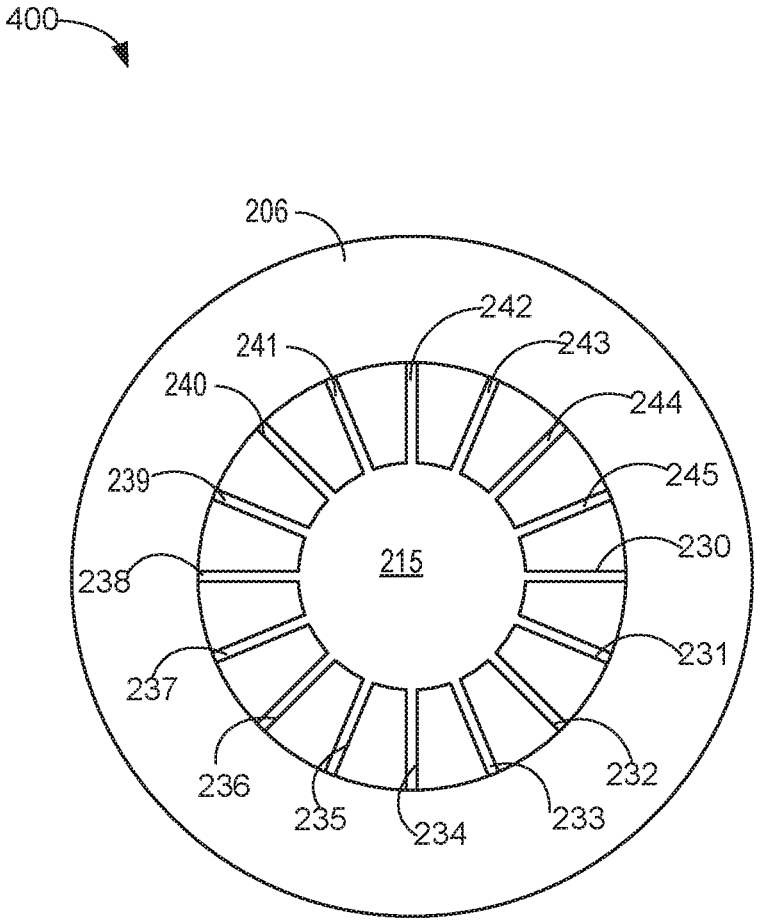
FIG. 4 shows a bottom up view of an injector nozzle with sixteen nozzle holes radially arranged around a center chamber of the fuel injector of FIG. 2.
Figure 5:
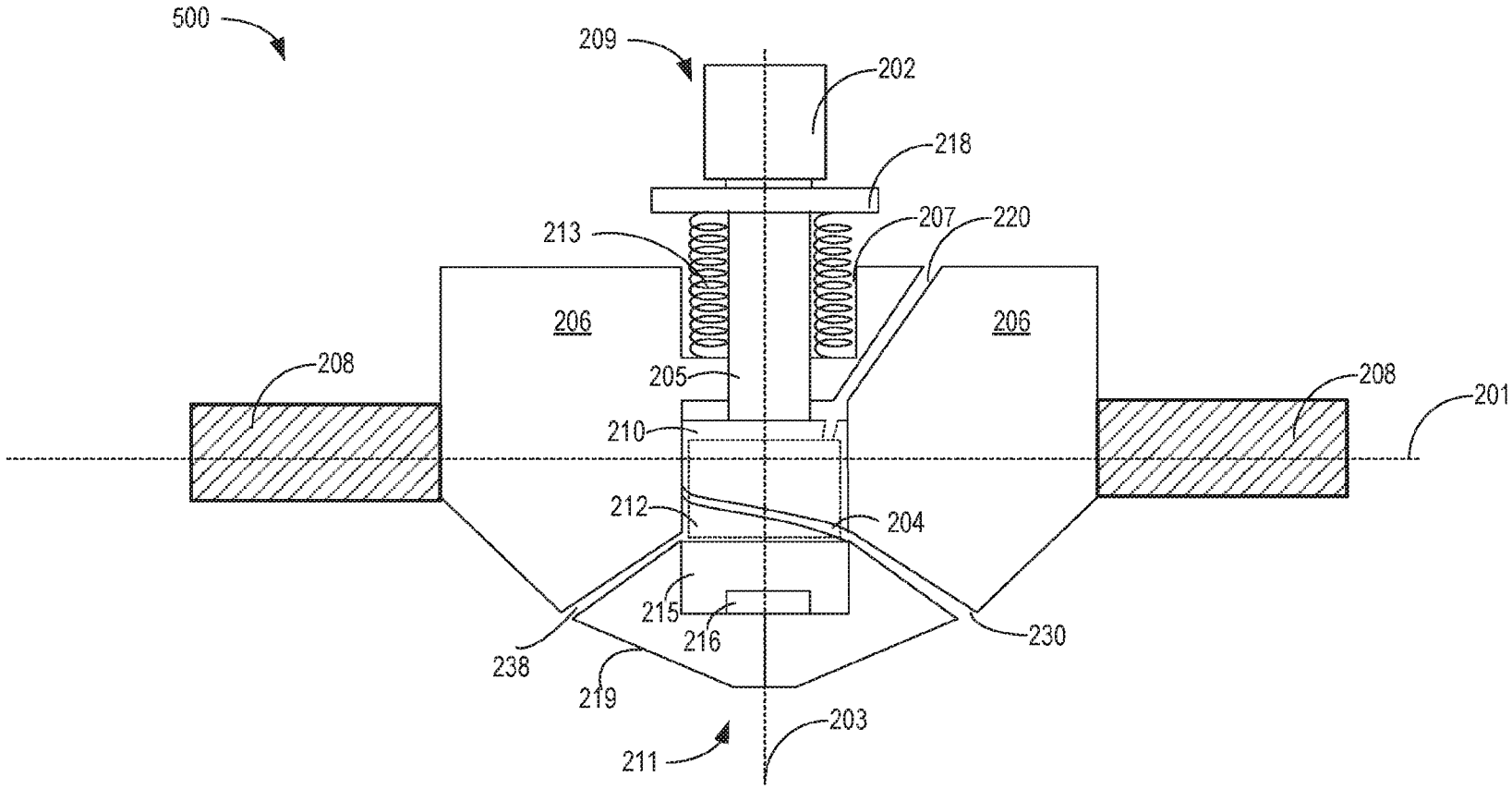
FIG. 5 shows the direct fuel injector assembly of FIG. 2 in a second position.
Figure 6:
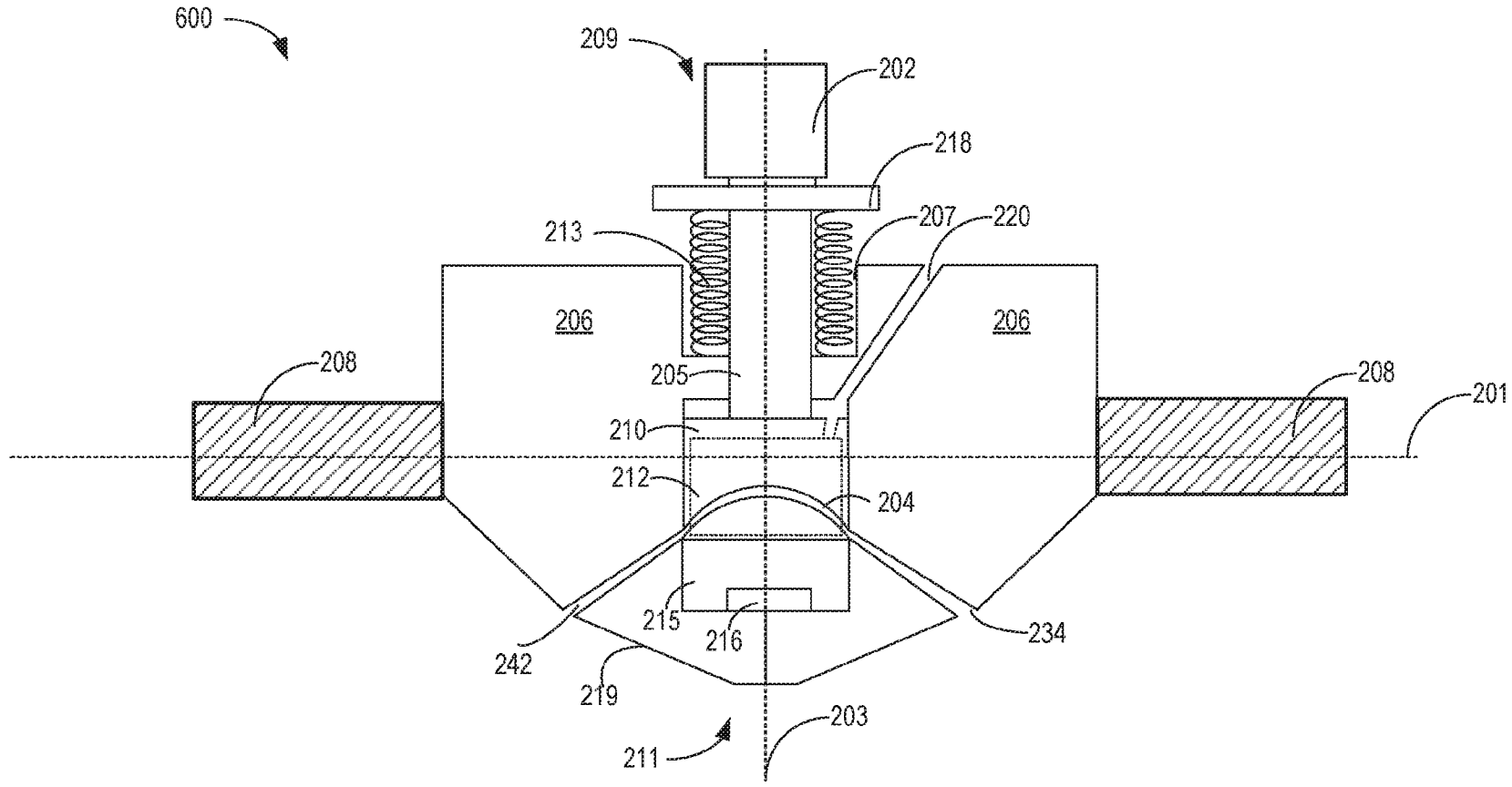
FIG. 6 shows the direct fuel injector assembly of FIG. 2 in a sixth position.
Figure 7:
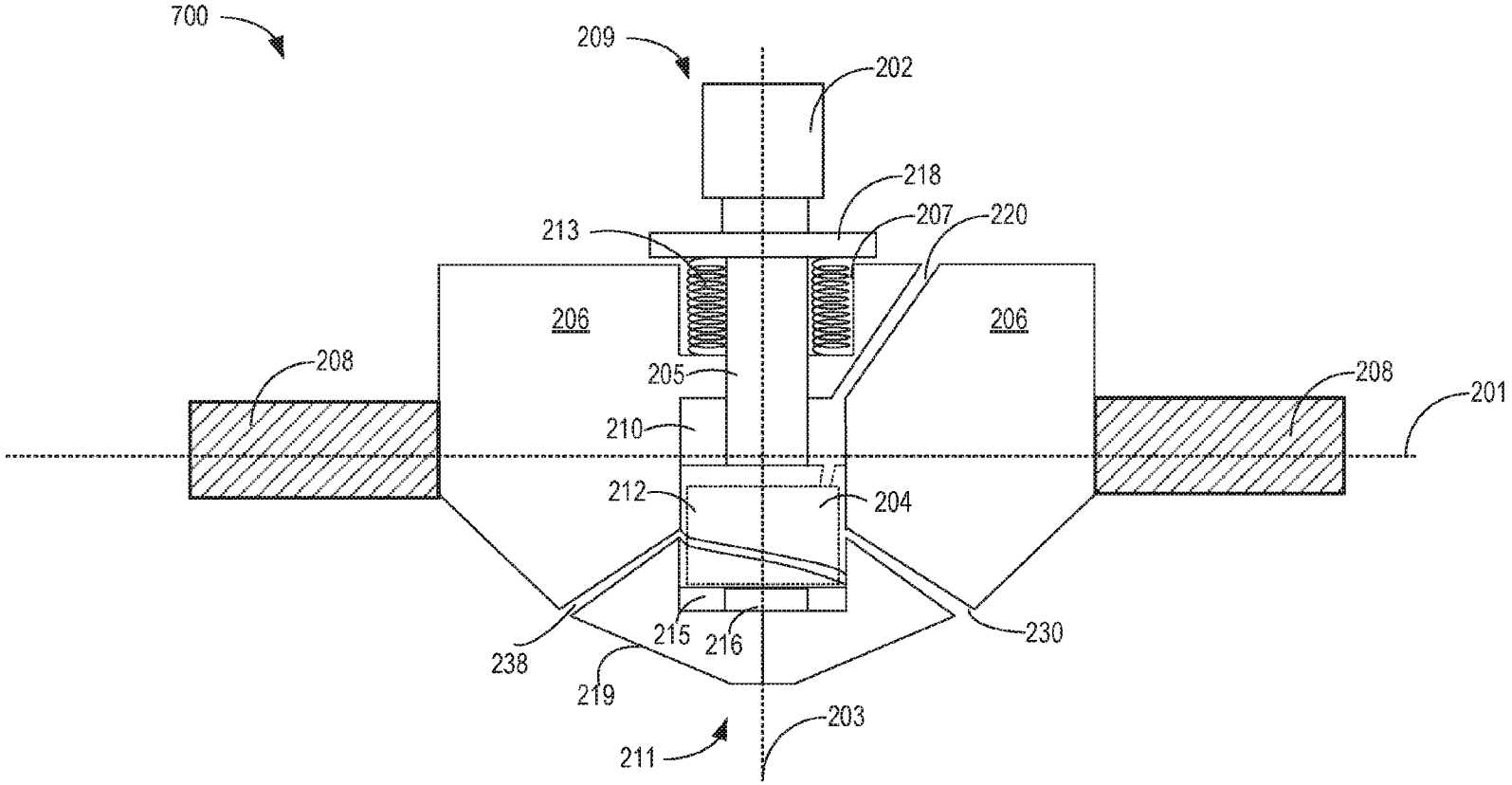
FIG. 7 shows the direct fuel injector assembly of FIG. 2 in a tenth position.
Figure 8:
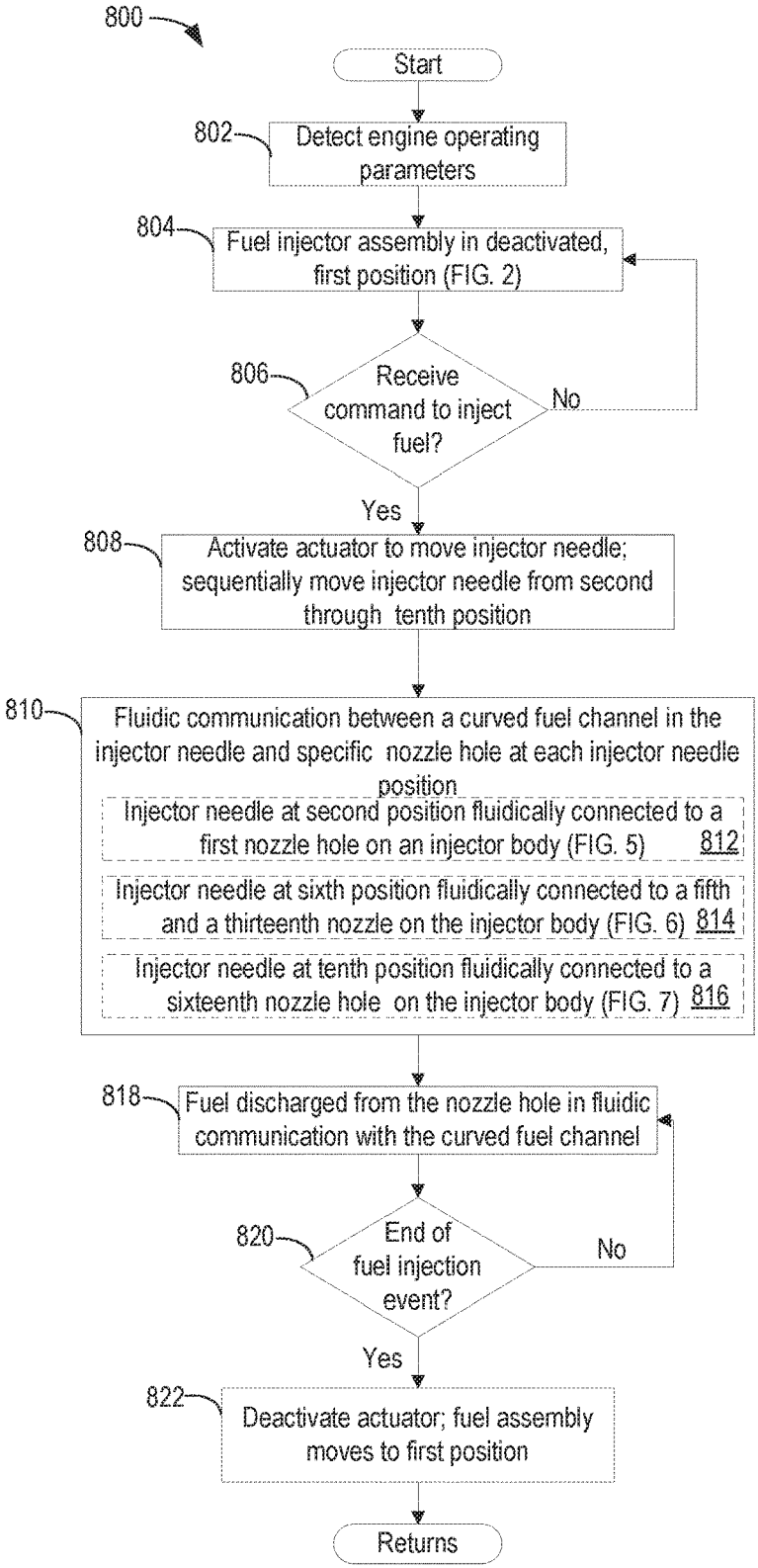
FIG. 8 is a flowchart showing a method for operating the direct fuel injector assembly of FIG. 2.

The following description relates to systems and methods for operating a direct fuel injector, which may be incorporated in an engine as shown in FIG. 1. FIG. 2 shows an embodiment of a fuel injector assembly with multiple nozzle holes and an injector needle with a curved fuel channel. The sequential positioning of the injector needle may fluidically connect the fuel channel to a specific nozzle hole, enabling fuel injection through that nozzle hole. FIG. 3 shows a schematic of the injector needle with the curved fuel channel and FIG. 4 shows the fuel injector nozzle holes. The position of the injector needle is regulated by an actuator and by retention springs coupled to the injector needle. In FIG. 2, the fuel injector assembly is in a deactivated position. In FIGS. 5, 6 and 7, the fuel injector assembly is in a second, a sixth and a tenth activated position, respectively. An engine controller may send control signals to an electric actuator coupled to a needle of the direct fuel injector to adjust the position of the nozzle and associated pin, as shown in FIG. 2 and FIGS. 5-7. The controller may perform a control routine, such as the example routine of FIG. 8, to transition the nozzle from a default deactivated position where all injector nozzle holes are closed, to sequentially positioning the injector needle where specific injector nozzle holes are injecting fuel. FIG. 8 depicts a method for injecting fuel by the fuel injector assembly described in FIGS. 2-7.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a deactivated state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Direct fuel injector 66 is shown positioned to inject fuel directly into cylinder 30, which is known to those skilled in the art as direct injection. Fuel injector 66 delivers liquid fuel in proportion to a voltage pulse width or fuel injector pulse width of a signal from controller 12. Fuel is delivered to fuel injector by a fuel system (not shown) including a fuel tank, fuel pump, and fuel rail (not shown). In addition, intake manifold 44 is shown communicating with optional electronic throttle 62, which adjusts a position of throttle plate 64 to control airflow from air intake 42 to intake manifold 44. Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a position sensor 154 coupled to brake pedal 150 for sensing force applied by foot 152, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine with multiple fuel injectors. Further, controller 12 may communicate conditions such as degradation of components to light, or alternatively, display panel 171.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

As explained above, a direct fuel injector may be used to supply fuel directly to a cylinder of an engine, as shown in FIG. 1. To increase atomization of the fuel, direct injectors may include a plurality of holes through which the fuel is supplied. Because the fuel is supplied to the direct injector at a high pressure, the fuel is typically injected from the direct injector with relatively high force. This may cause fuel spray interaction as the fuel is discharged through multiple injector holes, resulting in reduced fuel spray atomization, which may eventually compromise emissions. According to embodiments described below, a fuel injector may have an injector needle configured to sequentially move through multiple positions, where at each position fuel is injected though only one or two specific nozzle holes of a multi-hole nozzle injector, thus eliminating fuel spray interaction.

Referring to FIG. 2, an example of a fuel injector assembly 200 in an engine cylinder 208 is illustrated. The fuel injector assembly 200 may be one non-limiting example of injector 66 of FIG. 1. The fuel injector assembly 200 includes an injector body 206 housing an injector needle 205 with an injector pin 210 in a movable manner along a longitudinal axis 203 of the injector body 206 (also referred to a center axis of the injector body). The injector body 206 also houses a fuel passage 220 coupled to a fuel supply (e.g., a high pressure common fuel rail, fuel supply line(s), fuel pump(s), and fuel tank). An actuator 202 may be coupled to the injector needle 205. The actuator 202 may be an electric actuator. In other examples, the fuel injector may be actuated by other actuators, such as solenoid, piezoelectric, hydraulic, etc., without departing from the scope of this disclosure. In the example illustrated in FIG. 2, the longitudinal axis 203 of the fuel injector assembly 200 is perpendicular to a transverse axis 201 of the cylinder 208 and of the injector body. However, in other examples the injector may be positioned at a different angle relative to the transverse axis of the cylinder. The fuel injector assembly 200 includes a base end 211 positioned interior the cylinder 208 into which the fuel may be injected. The fuel injector assembly 200 also includes a top end 209, opposite the base end 211.

The fuel injector body 206 includes a central passage 207 connecting to a center chamber 215 housing the fuel injector needle 205 with the fuel injector pin 210, as illustrated in FIG. 2. The fuel injector needle 205 along with the fuel injector pin 210 is movable in a downward direction or in an upward direction in the central passage 207 and the center chamber 215 of the injector body 206. The fuel injector needle 205 is also coupled to a pair of retention springs 213. Each retention spring 213 coupled to the injector needle 205 may insert and anchor to a surface in the center passage 207 of the fuel injector body 206 and act to bias the injector needle 205 in an upward direction along the longitudinal axis 203 (e.g., away from the cylinder 208). The actuator 202 may move the needle 205 along the longitudinal axis 203 in a downward direction (e.g., toward the cylinder 208), against the force of the springs. A stop guide 218 attached to the top of the fuel injector needle 205 may restrict the downward motion of the injector needle when the stop guide 218 is in face sharing contact with the injector body 206, as will be described below with reference to FIG. 7.

The fuel injector needle 205 with the fuel injector pin 210 may be housed inside the center passage 207 and the center chamber 215. The injector pin 210 may be in face sharing contact with the inner surface of the center chamber 215 as the injector pin 210 along with the injector needle 205 moves downward or upward along the longitudinal axis 203. The injector pin 210 may be cylindrical and may include a fuel reservoir 212 and a curved fuel channel 204 around the circumference on the outer surface of the fuel injector pin 210, as illustrated in a schematic 300 in FIG. 3. The fuel reservoir 212 may be connected to the fuel passage 220 inside the injector body 206, which fuel passage 220 may be fluidically coupled to a high pressure fuel system. The fuel reservoir 212 may be in fluidic communication with the curved fuel channel 204 along the length of the curved fuel channel 204. The curved fuel channel 204 may be fluidically open to the center chamber 215 along the length of the curved fuel channel. In one example, the curved fuel channel may comprise an opening in the wall of the pin that traverses around an entirety of the pin. A tight, face-sharing contact between the injector pin 210 and the inner wall of the center chamber 215 may prevent fuel from exiting the curved fuel channel 204 into the center chamber 215.

Referring to FIG. 3, the curved fuel channel 204 may curve downwards from a high plane 250 to a lower plane 252 along the outer surface of the injector pin 210. The curve of the fuel channel from the high plane 250 towards the low plane 252 may be symmetrical on either side of the high plane 250, wherein the curved fuel channel 204 may symmetrically encircle the outer surface of injector pin 210. The relative positioning of the high plane 250 and the low plane 252 on the injector pin 210 may determine the curvature/slope of the curved fuel channel 204 encircling the injector pin 210. The curved fuel channel 204 may curve around the entirety of the pin, e.g., it may curve 360 degrees around the circumferential surface of the pin. The curved fuel channel may have a first point of symmetry at the high plane 250 that represents the maximum vertical displacement of the curved fuel channel relative to the bottom of the pin. The curved fuel channel may have a second point of symmetry at the low plane 252 that represents the minimum vertical displacement of the curved fuel channel relative to the bottom of the pin, and the maximum and minimum vertical displacements may be different. The curved fuel channel may be angled relative to a transverse axis of the injector pin; as shown in FIG. 3, the low plane 252 may be parallel to the transverse axis and at the low plane, the fuel channel may be angled at an angle greater than zero, such as angle of 15-30 degrees. The curved fuel channel may include a first half, from the first point of symmetry to the second point of symmetry, that is shaped as half of a turn of a helix in a downward direction. The curved fuel channel may include a second half, from the second point of symmetry back to the first point of symmetry, that is shaped as half of a turn of a helix in an upward direction.

Referring back to FIG. 2, the fuel injector body 206 includes an injector nozzle base 219 at the fuel injector base end 211. A needle seat 216 may project from the injector nozzle base 219 into the center chamber 215. The needle seat 216 may come in face sharing contact with the injector pin 210 housed inside the center chamber 215. A plurality of nozzle holes connect the center chamber 215 of the fuel injector to the outside of the fuel injector body 206. FIG. 4 shows a schematic bottom-up view of the fuel injector body 206 with sixteen nozzle holes, 230-245, fluidically connecting the center chamber 215 to the outside of the fuel injector body 206. The sixteen nozzle holes 230-245 may be radially arranged around the center chamber 215. In other examples, more than sixteen or less sixteen nozzle holes may be present. The distribution of the nozzle holes around the center chamber 215 may be symmetrical with similar distance between each of the consecutive nozzle holes. In another example, the arrangement of nozzle holes around the center chamber may not be symmetrical. The nozzle holes may traverse through the injector body 206 at an angle relative to the longitudinal axis 203, for example the nozzle holes 230 and 238 may be at an angle of 60° relative to the longitudinal axis 203. The nozzle holes 230-245 may be arranged in a single vertical plane, as illustrated. However, in other examples, the nozzle holes may arranged in two or more vertical planes.

FIG. 2 shows the fuel injector assembly 200 in a deactivated first position (where no fuel injection occurs), wherein actuator 202 is not activated, and the retention springs 213 bias the injector needle 205 upwards. The injector pin 210 is not in face sharing contact with the injector needle seat 216 and the curved fuel channel 204 is not in fluidic communication with any of the nozzle holes of the sixteen nozzle holes 230-245 of fuel injector (illustrated in FIG. 4), including no fluidic communication between the curved fuel channel and the nozzle holes 230 and 238, as illustrated in FIG. 2. Accordingly, fuel is blocked from exiting through the curved fuel channel 204 to any of the nozzle holes 230-245 and no fuel injection occurs.

FIG. 5 shows the fuel injector assembly 200 in a second position 500 wherein actuator 202 is activated and moves the injector needle 205 and the injector pin 210 downward (e.g., towards the cylinder) against the force of the retention springs 213. The injector pin 210 moves downward inside the center chamber 215, fluidically connecting the curved fuel channel 204 to the nozzle hole 230, establishing high pressure fuel flow from the fuel reservoir 212 of the pin 210, through the curved fuel channel 204, and through the nozzle hole 230 to the outside of the injector body and into the cylinder 208. In the second position, fluidic communication between the curved fuel channel and all other nozzle holes is blocked (e.g., fuel injection occurs only via the nozzle hole 230).

The actuator may subsequently move the injector needle 205 further downward, to a third position (not shown), such that the fluidic connection between the curved fuel channel 204 and the nozzle hole 230 is blocked, while simultaneously, fluidic communication is established between at least one other nozzle hole and the curved fuel channel at a different plane of the curved fuel channel. Because the open curved fuel channel is present along the circumference of the injector pin 210 and is symmetrically curved, in certain injector needle positions the curved fuel channel may be in fluidic communication with two nozzle holes, for example, in the third position, the curved fuel channel 204 may be in fluidic communication with the nozzle hole 231 and the nozzle hole 245 (the nozzle holes are shown in FIG. 4). In the third position, fuel is injected only though the nozzle holes 231 and 245, while other nozzle holes do not have fluidic communication with the curved fuel channel 204.

Subsequently the actuator may continue moving the injector needle 205 and the injector pin 210 downwards along the center chamber 215, to a fourth position (where the curved fuel channel 204 connects to the nozzle holes 232 and 244), followed by a fifth position (where the curved fuel channel 204 connects to the nozzle holes 233 and 243), and fuel is discharged through the respective nozzle holes at each position (positions not shown).

Moving the injector needle 205 further downwards, the injector needle may be in a sixth position 600, establishing fluidic communication and fuel flow though the nozzle holes 234 and 242, as shown in FIG. 6. The actuator may continue moving the injector needle downward, establishing fluidic communication at a seventh position with nozzle holes 235 and 241, at an eighth position with nozzle holes 236 and 240, at a ninth position with nozzle holes 237 and 239 (positions not shown). The injector may then be moved to a tenth position 700 fluidically connecting to nozzle hole 238.

FIG. 7 illustrates the fuel injector assembly 200 in the tenth position 700 with the curved fuel channel 204 fluidically coupled to the nozzle hole 238 while fluidic communication between the curved fuel channel and other nozzle holes may be blocked. In the tenth position, the injector needle stop guide 218 may be in face sharing contact with the injector body 206 and the needle seat 216 may be in face sharing contact with the pin 210 inside the center chamber 215, restricting any further downward movement of the injector needle 205 and the injector pin 210. While the fuel injector assembly 200 has been described herein has having ten positions including the deactivated position, in other examples, more or fewer positions of the fuel injector assembly may be present, depending on the number of nozzle holes. The fuel volume injected at each position may depend on the duration for which the position is retained and/or based on a size of the nozzle hole(s) at that position.

At the end of fuel injection, the actuator may be deactivated, and the retention springs 213 coupled to the injector needle may push the injector needle and the injector pin upward, away from the cylinder 208, moving the fuel injector assembly to the deactivated first position of FIG. 2. During the upward movement of the injector needle and the injector pin, the fuel injector may transition from the tenth position to the second position and finally to the deactivated first position. Moving back from the tenth position to the first position, a small volume of residual fuel may be discharged as each respective position re-establishes fluidic connection with the specific nozzle holes and the curved fuel channel. In one example, the duration of contact may be very short with minimal to no fuel discharge through the nozzle holes as the injector needle moves from the tenth to the first position.

Thus, a fuel injector includes a fuel injector body that includes a plurality of nozzle holes radially arranged around a center axis of the injector body. The injector body houses a needle coupled to a pin. The pin includes a fuel reservoir and a curved fuel channel in fluidic communication with the fuel reservoir. The curved fuel channel is curved in multiple directions, including curvature around the circumference of the pin (e.g., the channel is shaped as a circle or ellipse) as well as having a vertical curvature as it traverses around the pin (e.g., it is angled with respect to a transverse axis of the injector body/pin). As the needle and pin are moved downward with respect to the injector body, the fuel channel establishes sequential fluidic communication with each nozzle hole. In one example, the fuel channel has a high point of symmetry and a low point of symmetry. When the fuel channel fluidically couples to a nozzle hole at the high point (e.g., when the high point is at the same vertical plane as the nozzle holes), fluidic communication is only established between the fuel channel and one nozzle hole. Likewise, when the fuel channel fluidically couples to a nozzle hole at the low point (e.g., when the low point is at the same vertical plane as the nozzle holes), fluidic communication is only established between the fuel channel and one other nozzle hole. When the fuel channel fluidically couples to a nozzle hole at any point between the low point and the high point, fluidic communication is established between the fuel channel and two other nozzle holes. Thus, in one actuation event of the needle, the needle may travel through nine open positions, where fuel is first injected out of one nozzle hole, then injected out of seven pairs of nozzle holes sequentially, and then is injected out of one remaining nozzle hole.

FIG. 8 is a flow chart illustrating a method 800 for injecting fuel with a direct fuel injector, such as the fuel injector assembly 200 of FIGS. 2-7. At least portions of method 800 may be executed by a controller (e.g., controller 12) based on instructions stored on a memory of the controller and in conjunction with signals received from sensors of the engine system, such as the sensors described above with reference to FIG. 1. Additionally, portions of method 800 may be actions taken in the physical world to transform an operating state of an actuator or device, such as the actuator 202 of the fuel injector assembly 200.

Method 800 starts at 802 where engine operating parameters are detected. The engine operating parameters detected may include but are not limited to engine status (e.g., on or off), engine speed and load, current engine position, engine temperature, and other parameters. At 804, a fuel injector of the engine may be in a deactivated first position with no fuel injection through the fuel injector. In one example, the fuel injector may be the fuel injector assembly 200 illustrated in FIG. 2, wherein the injector needle 205 in the deactivated first position does not enable fluidic communication between the curved fuel channel 204 and any of the nozzle holes of the fuel injector. Hence, no fuel is injected into the cylinder.

At 806, method 800 assesses if there is a command for injecting fuel. Fuel may be injected in response to engine load above a threshold and/or in response to the engine firing order and engine position indicating that the injector is to inject fuel to initiate combustion in the cylinder. If no command to inject fuel is received, method 800 loops back to 804 and continues to hold the fuel injector in the deactivated first position. If the command for fuel injection is received, method 800 proceeds to 808 to activate an actuator (e.g., actuator 202) which may couple to an injector needle (e.g., needle 205) of the fuel injector. Activation of the actuator results in sequential movement of the injector needle downward (towards the engine cylinder) from the deactivated first position to multiple activated positions for enabling fuel injection. Examples of activated positions of the fuel injector assembly 200 are illustrated in FIGS. 5-7. In one example, the activated positions may include sequentially moving the injector needle 205 from the deactivated position to the second through the tenth activated positions, as described above with reference to FIGS. 2-7.

At 810, fluidic communication is established between the curved fuel channel and specific nozzle holes of the injector at each position. For example at 812, in the second position the curved fuel channel may be in fluidic communication with a first nozzle hole of the sixteen nozzle hole injector, as illustrated in FIG. 5. In another example, at 814, the injector needle in the sixth position may result in fluidic communication between the curved fuel channel and a fifth and a thirteenth nozzle hole of the sixteen nozzle holes of the injector (e.g., the nozzle holes 234 and 242 of the fuel injector assembly 200, as illustrated in FIG. 6). In a further example, at 816, the injector needle in the tenth position may result in fluidic communication between the curved fuel channel and the eighth nozzle hole of the sixteen nozzle holes of the fuel injector (e.g., the nozzle hole 238 of the fuel injector assembly), described above with reference to FIG. 7.

At 818, for each activated position of the injector, fuel is discharged through the specific nozzle hole in fluidic communication with the curved fuel channel at that position. For example, at the second position fuel is discharged from the nozzle hole 230, as illustrated in FIG. 5. In the sixth position, fuel is discharged from the nozzle holes 234 and 242, as shown in FIG. 6. In the tenth position, fuel is discharged from the nozzle hole 238, as shown in FIG. 7.

The extent of downwards movement of the needle and the duration for which the needle is held in that position may be controlled by the electric actuator in order to control the volume of fuel being injected and spray penetration of the injected fuel at each position of the fuel injector. In some examples, certain injector positions may be held longer than other positions, for example during high engine load the two hole positions may be held longer than the single hole position. The reverse may be true during low engine speed and/or load.

At 820, method 800 determines if the end of fuel injection event is reached. The duration of the fuel injection event may be based on the volume of charge air inducted into the cylinder and commanded air-fuel ratio, where the volume of charge air may be based on engine parameters such as engine speed, engine load, etc. If the end of the fuel injection event is not reached, method 800 loops back to 818 to continue to inject fuel with the fuel injector assembly sequentially moving from the second through the tenth position, establishing fluidic connection between the curved channel and specific nozzle holes. If the end of the fuel injection event is reached, the method 800 deactivates the actuator. At end of a fuel injection event, the actuator may be disabled and a pair of retention springs may move the injector needle from the tenth position to the first deactivated position, as illustrated in FIG. 2, disrupting fluidic communication between the curved open fuel channel and the nozzle holes. While the injector needle is moving upward, it may sequentially transition from the tenth position to the deactivated first position, during which some residual fuel may be discharged through each of the nozzle holes fluidically connecting with the open channel. As the injector needle reaches the first position, fuel discharge may stop and the method 800 returns.

The fuel flow to the cylinder may be regulated and fuel spray interaction minimized by the above described method of controlling the position of the fuel injector needle to enable or disable fluidic communication between the curved fuel channel and specific nozzle hole of the fuel injector at each position.

Thus, a fuel injector assembly with an injector needle with a curved fuel channel may be sequentially positioned to enable fluidic communication and fuel discharge through specific nozzle hole at one given position, thereby minimizing fuel spray interaction in the multi-hole fuel injector, and increasing combustion efficiency.

The technical effect of fuel injection through a multi-hole fuel injector with minimal fuel spray interaction between the fuel sprays being discharged from the nozzle holes is reduced fuel penetration and increase in air-fuel mixing, which may result in more efficient combustion and reduce emissions.

An embodiment of a fuel injector system comprises an injector body with a plurality of nozzle holes, and an injector needle coupled to an injector pin, the injector pin including a curved fuel channel in fluidic communication with a fuel reservoir inside the injector pin, the injector needle and pin housed inside the injector body, the curved fuel channel configured to be in fluidic communication with the plurality of nozzle holes when the injector needle is actuated. In a first example of the fuel injector system, the system further comprises an actuator coupled to the injector needle, and a controller storing non-transitory instructions that when executed cause the controller to, responsive to a command to inject fuel, activate the actuator to push the injector needle in a downward direction, sequentially establishing fluidic communication between the curved fuel channel and each nozzle hole. A second example of the system optionally includes the first example and further includes wherein when the actuator pushes the injector needle to a first position, fluidic communication is established between the curved fuel channel and a first nozzle hole. A third example of the system optionally include one or both of the first and second examples, and further includes wherein when the actuator pushes the injector needle to a second position, fluidic communication is established between the curved fuel channel and a second nozzle hole, and between the curved fuel channel and a third nozzle hole. A fourth example of the system optionally includes one or more or each of the first through third examples, and further includes wherein when the actuator pushes the injector needle to the first position, fluidic communication between the curved fuel channel and the second nozzle hole is blocked, and fluidic communication between the curved fuel channel and the third nozzle hole is blocked. A fifth example of the system optionally includes one or more or each of the first through fourth examples, and further includes wherein when the actuator pushes the injector needle to the second position, fluidic communication between the curved fuel channel and the first nozzle hole is blocked. A sixth example of the system optionally includes one or more or each of the first through fifth examples, and further includes wherein when the actuator is activated, fluidic communication is sequentially established between the curved fuel channel and only a first nozzle hole, then a first set of nozzle holes, then a second set of nozzle holes, then a third set of nozzle holes, then a fourth set of nozzle holes, then a fifth set of nozzle holes, then a sixth set of nozzle holes, then a seventh set of holes, and then only a last nozzle hole. A seventh example of the system optionally includes one or more or each of the first through sixth examples, and further includes wherein the plurality of nozzle holes comprise sixteen nozzle holes arranged radially around a center axis of the injector body. An eighth example of the system optionally includes one or more or each of the first through seventh examples, and further includes wherein each of the plurality of nozzle holes is located in a same vertical plane. A ninth example of the system optionally includes one or more or each of the first through eighth examples, and further includes wherein the curved fuel channel curves 360 degrees around a circumferential surface of the injector pin. A tenth example of the system optionally includes one or more or each of the first through ninth examples, and further includes wherein the curved fuel channel is positioned at angle relative to a transverse axis of the injector pin, such that the curved fuel channel passes through multiple vertical planes as it curves around the circumferential surface of the injector pin. An eleventh example of the system optionally includes one or more or each of the first through tenth examples, and further includes wherein the fuel reservoir inside the injector pin is fluidically coupled to a fuel supply.

An embodiment for a method for a fuel injector comprises actuating a needle housed within a body of the fuel injector to sequentially move the needle downward from a closed position through a plurality of open positions, fluidically connecting a curved fuel channel of the fuel injector to at least one nozzle hole of the fuel injector at each open position of the plurality of open positions. In a first example of the method, the method further comprises flowing fuel from a fuel supply to a fuel reservoir within the needle, the fuel in the fuel reservoir flowing through the curved fuel channel and through each respective nozzle hole of the fuel injector as the needle moves downward. A second example of the method optionally includes the first example and further includes wherein actuating the needle comprises actuating the needle in response to a command to inject fuel to a cylinder in which the fuel injector is housed. A third example of the method optionally includes one or both of the first and second examples and further includes wherein actuating the needle to sequentially move the needle downward from a closed position through the plurality of open positions comprises actuating the needle to sequentially move through nine open positions. A fourth example of the method optionally includes one or more or each of the first through third examples, and further includes wherein actuating the needle to sequentially move through nine open positions comprises: actuating the needle to move to a first open position where fluidic communication is established between the curved fuel channel and a first nozzle hole; actuating the needle to move to a second through an eighth open position where in each of the second through eighth open positions, fluidic communication is established between the curved fuel channel a respective pair of nozzle holes; and actuating the needle to move to a ninth open position where fluidic communication is established between the curved fuel channel and a last nozzle hole.

An embodiment of a system comprises an engine having a cylinder; a fuel supply; a fuel injector coupled to the cylinder, the fuel injector comprising: an injector body with a plurality of nozzle holes, the injector body including a fuel passage coupled to the fuel supply; an injector needle coupled to an injector pin, the injector pin encircled by a curved fuel channel in fluidic communication with a fuel reservoir inside the injector pin, the injector pin housed inside the injector body, the fuel reservoir in fluidic communication with the fuel passage; and an actuator coupled to the injector needle; and a controller storing non-transitory instructions in memory that when executed cause the controller to, responsive to a command to inject fuel to the cylinder, activate the actuator to push the needle in a downward direction, sequentially establishing fluidic communication between the curved fuel channel and a respective nozzle hole of the plurality of nozzle holes. In a first example of the system, the plurality of nozzle holes comprise sixteen nozzle holes arranged radially around a center axis of the injector body, wherein each of the plurality of nozzle holes is located in a same vertical plane. A second example of the system optionally includes the first example and further includes the curved fuel channel curves 360 degrees around a circumferential surface of the injector pin.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed four, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fuel injector system, comprising:

an injector body with a plurality of nozzle holes; and an injector needle coupled to an injector pin, the injector pin including a curved fuel channel in fluidic communication with a fuel reservoir inside the injector pin, the injector needle and injector pin housed inside the injector body;

where, in a first position, the curved fuel channel is configured to be in fluidic communication with only one of the plurality of nozzle holes to generate an asymmetric spray pattern;

where, in a second position, the curved fuel channel is configured to be in fluidic communication with two or more of the plurality of nozzle holes to generate a symmetric spray pattern; and where the fuel injector system transitions between the first position to generate the asymmetric spray pattern and the second position to generate the symmetric spray pattern based on one or more of engine speed, engine load, and engine temperature.

2. The fuel injector system of claim 1, further comprising:

an actuator coupled to the injector needle; and a controller storing non-transitory instructions that when executed cause the controller to, responsive to a command to inject fuel, activate the actuator to push the injector needle in a downward direction, sequentially establishing fluidic communication between the curved fuel channel and each of the plurality of nozzle holes.

3. The fuel injector system of claim 2, wherein when the actuator pushes the injector needle to the first position, fluidic communication is established between the curved fuel channel and a first nozzle hole.

4. The fuel injector system of claim 3, wherein when the actuator pushes the injector needle to the second position, fluidic communication is established between the curved fuel channel and a second nozzle hole, and between the curved fuel channel and a third nozzle hole.

5. The fuel injector system of claim 4, wherein when the actuator pushes the injector needle to the first position, fluidic communication between the curved fuel channel and the second nozzle hole is blocked, and fluidic communication between the curved fuel channel and the third nozzle hole is blocked.

6. The fuel injector system of claim 4, wherein when the actuator pushes the injector needle to the second position, fluidic communication between the curved fuel channel and the first nozzle hole is blocked.

7. The fuel injector system of claim 2, wherein when the actuator is activated, fluidic communication is sequentially established between the curved fuel channel and only a first nozzle hole, then a first set of nozzle holes, then a second set of nozzle holes, then a third set of nozzle holes, then a fourth set of nozzle holes, then a fifth set of nozzle holes, then a sixth set of nozzle holes, then a seventh set of holes, and then only a last nozzle hole.

8. The fuel injector system of claim 1, wherein the plurality of nozzle holes comprises sixteen nozzle holes arranged radially around a center axis of the injector body.

9. The fuel injector system of claim 1, wherein each of the plurality of nozzle holes is located in a common vertical plane.

10. The fuel injector system of claim 1, wherein the curved fuel channel curves 360 degrees around a circumferential surface of the injector pin.

11. The fuel injector system of claim 10, wherein the curved fuel channel is positioned at an angle relative to a transverse axis of the injector pin, such that the curved fuel channel passes through multiple vertical planes as it curves around the circumferential surface of the injector pin.

12. The fuel injector system of claim 1, wherein the fuel reservoir inside the injector pin is fluidically coupled to a fuel supply.

13. A method for a fuel injector, comprising:

actuating a needle housed within a body of the fuel injector to sequentially move the needle downward from a closed position through a plurality of open positions, where in one of the plurality of open positions a curved fuel channel of the fuel injector is fluidically connected to a single nozzle hole to generate an asymmetric spray pattern, and in another of the plurality of open positions the curved fuel channel is fluidically connected to at least two nozzle holes to generate a symmetric spray pattern; and transitioning between the open position that generates the asymmetric spray pattern and the open position that generates the symmetric spray pattern based on one or more of engine speed, engine load, and engine temperature.

14. The method of claim 13, further comprising flowing fuel from a fuel supply to a fuel reservoir within the needle, the fuel in the fuel reservoir flowing through the curved fuel channel and through each respective nozzle hole of the fuel injector as the needle moves downward.

15. The method of claim 13, wherein actuating the needle comprises actuating the needle in response to a command to inject fuel to a cylinder in which the fuel injector is housed.

16. The method of claim 13, wherein actuating the needle to sequentially move the needle downward from the closed position through the plurality of open positions comprises actuating the needle to sequentially move through nine open positions.

17. The method of claim 16, wherein actuating the needle to sequentially move through nine open positions comprises:

actuating the needle to move to a first open position where fluidic communication is established between the curved fuel channel and a first nozzle hole;

actuating the needle to move to a second through an eighth open position where in each of the second through eighth open positions, fluidic communication is established between the curved fuel channel and a respective pair of nozzle holes; and actuating the needle to move to a ninth open position where fluidic communication is established between the curved fuel channel and a last nozzle hole.

18. A system, comprising:

an engine having a cylinder;

a fuel supply;

a fuel injector coupled to the cylinder, the fuel injector comprising:

an injector body with a plurality of nozzle holes, the injector body including a fuel passage coupled to the fuel supply;

an injector needle coupled to an injector pin, the injector pin encircled by a curved fuel channel in fluidic communication with a fuel reservoir inside the injector pin, the injector pin housed inside the injector body, the fuel reservoir in fluidic communication with the fuel passage; and an actuator coupled to the injector needle; and a controller storing non-transitory instructions in memory that when executed cause the controller to:

responsive to a command to inject fuel to the cylinder, activate the actuator to push the injector needle in a downward direction into a first position where the curved fuel channel is in fluidic communication with only one of the plurality of nozzle holes to generate an asymmetric spray pattern, and into a second position where the curved fuel channel is configured to be in fluidic communication with two or more of the plurality of nozzle holes to generate a symmetric spray pattern; and transition between the first position to generate the asymmetric spray pattern and the second position to generate the symmetric spray pattern based on one or more of engine speed, engine load, and engine temperature.

19. The system of claim 18, wherein the plurality of nozzle holes comprises sixteen nozzle holes arranged radially around a center axis of the injector body, wherein each of the plurality of nozzle holes is located in a common vertical plane.

20. The system of claim 18, wherein the curved fuel channel curves 360 degrees around a circumferential surface of the injector pin.

* * * * *